United States Patent [19]

Heshmatpour et al.

[11] 4,406,693

[45] Sep. 27, 1983

[54] METHOD FOR REFINING CONTAMINATED IRIDIUM

[76] Inventors: Bahman Heshmatpour, Waltham, Mass.; Richard L. Heestand, Oak Ridge, Tenn.

[75] Inventors: Bahman Heshmatpour, Waltham, Mass.; Richard L. Heestand, Oak Ridge, Tenn.

[73] Assignee: The United States of America as represented by the U.S. Department of Energy, Washington, D.C.

[21] Appl. No.: 413,636

[22] Filed: Aug. 31, 1982

[51] Int. Cl.[3] ..... B22F 9/16; C22B 11/06

[52] U.S. Cl. ..... 75/0.5 A; 75/121; 75/251; 420/434

[58] Field of Search ..... 75/0.5 A, 101 R, 121, 75/251; 420/461, 493, 497, 434; 423/22

[56] References Cited

U.S. PATENT DOCUMENTS 3,841,863 10/1974 Caldwell et al. ..... 75/121
3,876,747 4/1975 Pittie et al. ..... 75/121

OTHER PUBLICATIONS

F. S. Clements, "Twenty-Five Years' Progress in Platinum Metals Refining," The Industrial Chemist, Jul. 1962, pp. 345–354.

*Rare Metals Handbook,* Second Edition, Reinhold Publishing Corporation, pp. 304–315 and 326–335.

*Primary Examiner*—O. R. Vertiz
*Assistant Examiner*—Robert L. Stoll
*Attorney, Agent, or Firm*—Edwin D. Grant; Stephen D. Hamel; Richard G. Besha

[57] ABSTRACT

Contaminated iridium is refined by alloying it with an alloying agent selected from the group consisting of manganese and an alloy of manganese and copper, and then dissolving the alloying agent from the formed alloy to provide a purified iridium powder.

1 Claim, No Drawings

METHOD FOR REFINING CONTAMINATED IRIDIUM

BACKGROUND OF THE INVENTION

This invention, which resulted from a contract with the United States Department of Energy, relates to a method for purifying iridium metal which contains a contaminant.

Fabrication of iridium cladding for nuclear fuel spheres generates scrap iridium which contains contamination in the form of oxides, carbides, and metallic impurities. Because of the value of the iridium in such scrap, it is presently refined and recovered by a conventional process in which the scrap is alloyed with nickel in the proportion of 70% nickel and 30% iridium on a weight basis, and the iridium is recovered as an impure powder by acid leaching of this alloy. The impure iridium is then subjected to several complex oxidation, dissolution and purification steps to obtain iridium having a higher degree of purity. Some of the iridium is lost in this complex refinement process.

SUMMARY OF THE INVENTION

It is therefore an object of this invention to provide an improved process for removing contamination from iridium metal.

Another object of the invention is to purify iridium scrap by means of a process that is simpler and less costly to perform than the conventional refinement process presently used for this purpose.

These objects are achieved by the preferred method of the invention which comprises (1) forming an alloy consisting of contaminated iridium scrap and an alloying agent selected from the group consisting of manganese and an alloy of manganese and copper, and (2) dissolving said alloying agent from said alloy to provide refined iridium powder.

DETAILED DESCRIPTION OF THE INVENTION

In an attempt to find an improved method for purifying contaminated iridium, several metals and alloys were alloyed with scrap iridium by melting the scrap and the particular alloying agents in an induction furnace. The ingots formed were then placed in hydrochloric acid to dissolve the alloying agent therefrom, leaving iridium in the form of powder. If no significant leaching of an alloying agent from an ingot was observed by use of HCl, other acids including $HNO_3$ and $H_2SO_4$ were employed. However, the use of $HNO_3$ and $H_2SO_4$, or mixtures thereof, tended to oxidize or dissolve part of the iridium, resulting in a smaller recovery of the product metals. As will be shown by reference to specific examples hereinafter, it was found that purer iridium can be obtained by alloying the scrap iridium with manganese, or with an alloy of manganese and copper, than by use of the conventional nickel alloying agent. In the case of the ductile alloy formed by melting together approximately 20% Mn, 20% Cu, and 60% Ir by weight, hydrochloric acid leaching provided iridium powder with about 95% purity. Alloys containing manganese and 10–30% iridium were found to be harder and more brittle than the previously mentioned 20% Mn, 20% Cu, 60% Ir alloy but also formed a very fine iridium powder with 98–99% purity when leached with HCl. Both of these Mn-Ir and Mn-Cu-Ir alloys form homogeneous solid solutions with iridium, have a low melting point of about 1300° C., dissolve readily in dilute HCl, and are inexpensive compared with nickel, the alloying agent which has previously been used.

The powder formed by leaching the aforesaid alloys in hydrochloric acid is fine (about 100 mesh). In comparison, the Ni-Ir alloy that is presently used has a high melting point (about 1800° C.), a slow leaching rate in hydrochloric acid, and the powder resulting from the leaching step of the process is coarse (about 40 mesh) and comparatively impure, containing about 20% by weight Ni. In addition, as mentioned hereinbefore, considerable iridium is lost by the steps required for removing nickel from the powder obtained by the conventional alloying process. The invention will be further described by reference to the following example.

EXAMPLE

Scrap iridium in the form of solid or powder with varying degrees of impurity content, typically containing about 10 to 99.6% iridium, was induction-melted with various metals and alloys in a recrystallized, aluminum crystal. Impurities typically may include $PuO_2$, SiC, WC, $ZrO_2$, $Al_2O_3$, Fe, Cr, or Ni, depending on the source of scrap. The temperature of the melt was raised 100°–200° above the melting point of the alloy to assure complete dissolution of the iridium in the solvent metal. After melting, the induction unit was turned off, the melt was permitted to solidify, and slag was removed from the surface of the alloy ingot by wire brushing to remove attached impurities. The ingot was then leached in 20%HCl acid to dissolve the solvent metal, leaving purified iridium in the form of a fine powder.

The particle size of the iridium powder depended on the solvent metal or alloy used and the type of acid used for leaching the ingot. The purity or iridium content of the product was also dependent on the solvent or alloy.

The results of the above runs are summarized in Table I.

TABLE I

Summary of Ir Scrap Recovery Tests

| Test No. | Ir in Scrap (%) | Alloy Composition (appr. % by weight) | Melting Point (°C.) | Ingot* Ductility | Ir Sol* in Alloy | Leach rate in acid* | Product Size (mesh) | Recovery (%)* | Ir in Product (%)* |
|---|---|---|---|---|---|---|---|---|---|
| 1 | 95 | 70Ni—29Ir | 1750 | g | s | p | 40 | 95 | 70 |
| 2 | 70 | 70Cu—20Ir | 1300 | g | ps | p | 40 | 70 | 70 |
| 3 | 99.5 | 75Cu—24Ir | 1320 | g | ps | p | 40 | 70 | 85 |
| 4 | 85 | 60Cu—20Ni—17Ir | 1380 | g | ps | p | 40 | 60 | 50 |
| 5 | 99.5 | 75Fe-20Ir—3C | 1440 | p | ps | vp | 40 | 60 | 70 |
| 6 | 91 | 42Fe—20Ir—19Al—9Mn—5Cu—3C | 1250 | p | ps | vp | 40 | 60 | 60 |
| 7 | 78 | 30Mn—27Fe—20Ni—18Ir | 1570 | p | s | vp | 40 | 60 | 46 |
| 8 | 79 | 74Mn—15Ir—7Cu | 1370 | p | s | e | 100 | 100 | 93 |
| 9 | 83 | 75Mn—15Ir—3Cu—2Ni—2Fe | 1380 | p | s | e | 100 | 90 | 96 |
| 10 | 95 | 90Mn—9.5Ir | 1340 | p | s | e | 100 | 95 | 98 |
| 11 | 99.5 | 70Mn—29.5Ir | 1580 | p | s | e | 100 | 100 | 98 |

TABLE I-continued

| Test No. | Ir in Scrap (%) | Alloy Composition (appr. % by weight) | Summary of Ir Scrap Recovery Tests: Melting Point (°C.) | Ingot* Ductility | Ir Sol* in Alloy | Leach rate in acid* | Product Size (mesh) | Recovery (%)* | Ir in Product (%)* |
|---|---|---|---|---|---|---|---|---|---|
| 12 | 99.5 | 80Mn—19.5Ir | 1460 | p | s | e | 100 | 100 | 99 |
| 13 | 99.5 | 60Mn—20Cu—20Ni—19.5Ir | 1250 | g | s | p | 40 | nm | nm |
| 14 | 99.5 | 60Mn—19.5Ir—10Cu—10Ni | 1280 | g | s | p | 40 | nm | nm |
| 15 | 91 | 58Mn—20Cu—20Ir | 1300 | g | s | e | 100 | 98 | 95 |

*g = good, p = poor, s = soluble, ps = partially soluble, vp = very poor, e = excellent, nm = not measured These results indicate that an alloy containing about 70% to 90% manganese and about 10% to 30% iridium by weight and an alloy containing about 60% manganese, 20% copper, and 20% iridium by weight provided excellent leach rates, a fine product size, and a high recovery of nearly pure iridium product.

In the event that a high product purity (i.e., greater than 99%) is desired, known hydrochemical treatment may be used as a final step. If 98–99% purity is acceptable, further refining is not necessary.

What is claimed is:

1. A method of refining iridium containing a contaminant, comprising:

forming an alloy ingot of the contaminated iridium and an alloying agent selected from the group consisting of manganese and a mixture of manganese and copper sufficient to provide at least 58% by weight manganese in said alloy ingot; and dissolving said alloying agent from said alloy ingot with hydrochloric acid to provide refined iridium powder.

* * * * *